United States Patent [19]

Porter

[11] 4,275,534

[45] Jun. 30, 1981

[54] HEXAGONAL BUILDING STRUCTURES

[75] Inventor: William H. Porter, West Olive, Mich.

[73] Assignee: W. H. Porter, Inc., Holland, Mich.

[21] Appl. No.: 1,311

[22] Filed: Jan. 5, 1979

Related U.S. Application Data

[63] Continuation-in-part of Ser. No. 805,781, Jun. 13, 1977, abandoned.

[51] Int. Cl.[3] ..... E04B 7/00

[52] U.S. Cl. ..... 52/82; 52/648; 52/721

[58] Field of Search ..... 52/80, 81, 82, 648, 52/86, 245, 247, 248, 236.1, 236.2, 296, 721, 731

[56] References Cited

U.S. PATENT DOCUMENTS

| | | | |
|---|---|---|---|
| 595,875 | 12/1897 | Ernest | 52/82 X |
| 2,775,794 | 1/1957 | Keely | 52/82 |
| 3,281,999 | 11/1966 | Keely | 52/248 X |
| 3,807,101 | 4/1974 | Cole | 52/82 X |
| 3,908,329 | 9/1975 | Walters | 52/82 X |
| 3,921,354 | 11/1975 | Connelly et al. | 52/73 X |
| 4,068,437 | 1/1978 | Byxbe et al. | 52/82 X |

*Primary Examiner*—John E. Murtagh
*Assistant Examiner*—Carl D. Friedman
*Attorney, Agent, or Firm*—Emrich, Root, Lee, Brown & Hill

[57] ABSTRACT

A structure for a hexagonal building has a novel steel frame including a connection which joins tension ring members, columns and roof trusses together with threaded fasteners. The upper ends of the rafters are joined by a tension ring. The bottom of each column is secured to a base by means of an adjustable base plate. Rafters spanning between the tension ring and compression ring are located between adjacent trusses. The frame is adapted to receive prefabricated sandwich-type panels for both roof and walls.

8 Claims, 13 Drawing Figures

17
18A
19
18
19A 27
25
28

16
24
37
30
23
34
35
42
41
42
46
47
48
49

68
75
63
64
15
77
74
78
65
61
60
62
84
82

20
40
40A
11
50
50
20
68
73
72
70
71
69
129
123
15
122
130
12
54
53
52

11
125
S
127
128
126

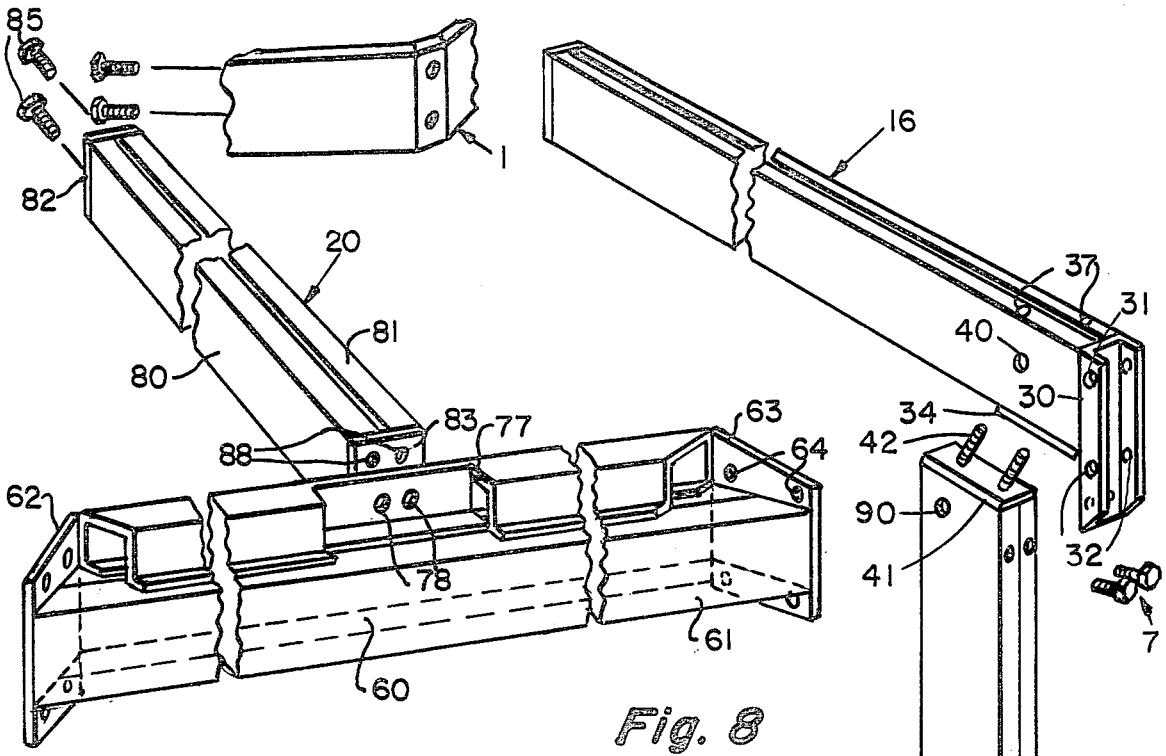
Fig. 8
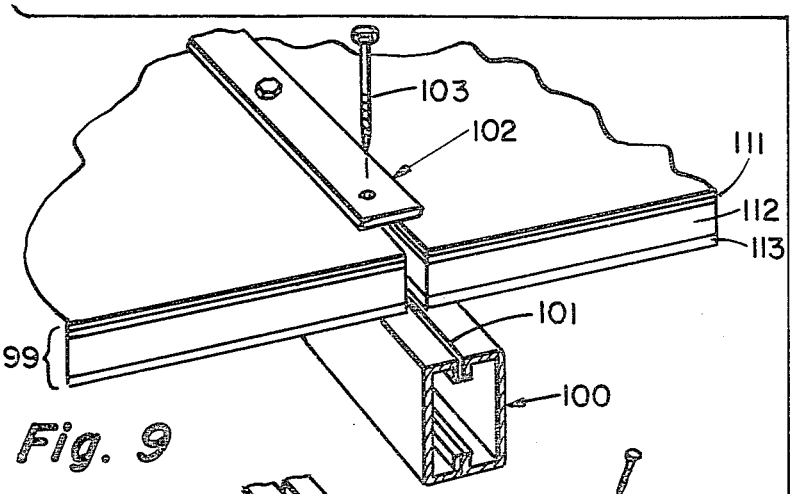
Fig. 9
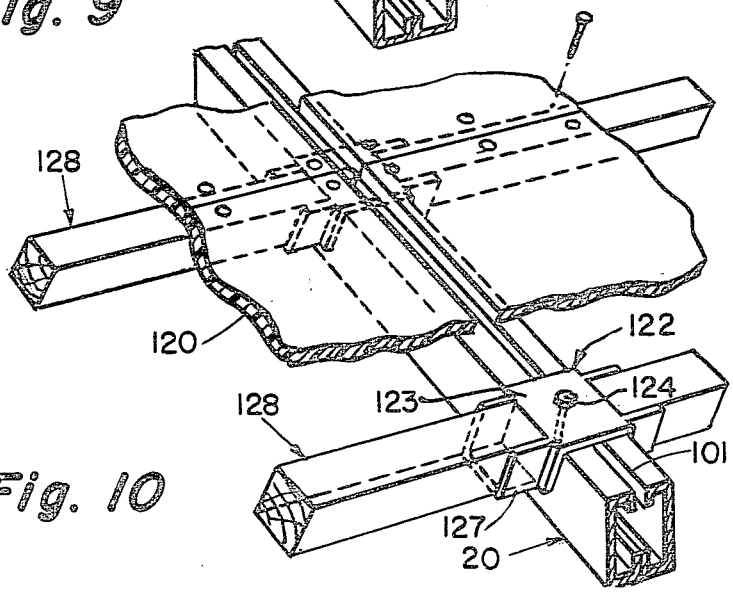
Fig. 10
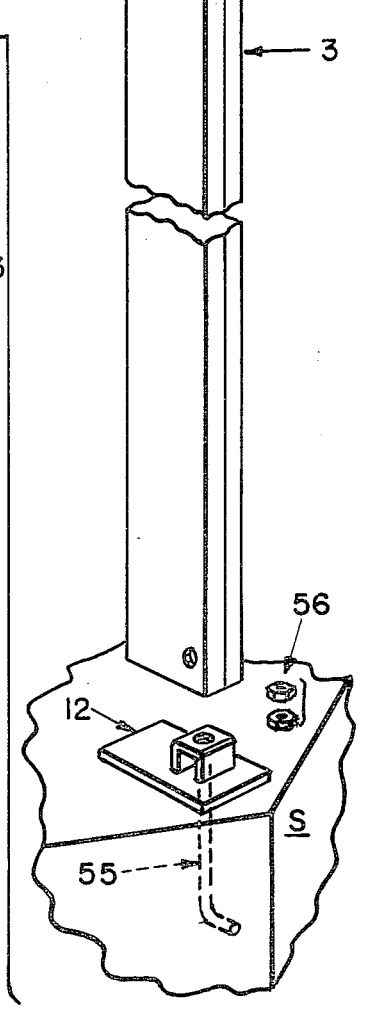

142
143
146
141
147
153
152
165
163
158
150
160
159
156
161
151
155
159
150
100
142
143
146
141
153
145
152
141
150
150
151
100

HEXAGONAL BUILDING STRUCTURES

RELATED APPLICATION

This is a continuation-in-part application of my application entitled *IMPROVEMENTS IN HEXAGONAL BUILDING STRUCTURES,* Ser. No. 805,781, filed June 13, 1977 (abandoned).

BACKGROUND AND SUMMARY

The present invention relates to improvements in hexagonal building structures. It is known that buildings having geometrical plan shapes, such as hexagons and octagons can be fabricated using a frame of steel or other metal including a tension ring and a compression ring to form the roof support.

The terms "tension ring" and "compression ring" are terms of art. Briefly, a tension ring includes a rigid member extending between and joining the tops of all columns. Roof trusses extend from the column to a central integral member, generally of a shape similar to that of the plan shape of the building and the tension ring, called the "compression ring". Thus, the compression ring joins the inner ends of the roof trusses and rafters, whereas the compression ring joins the outer ends of the roof trusses and rafters, and couples them to the support columns. When load is applied to the roof, the inner ring is placed in compression and the outer ring is placed in tension, thus giving rise to the terms of art.

According to the present invention, the tension ring is supplied in six separate tubular steel beams to be fabricated into the tension ring at the construction site. Further, a novel connection joins the tension ring members to the columns and the outer ends of the roof trusses with threaded fasteners, thereby facilitating erection and, if desired, breakdown of the building frame. Further, the tension ring members are specially provided with channels for securing the lowermost portion of roof panels as well as for securing the upper edge of wall panels to permit the wall panels to be inserted or removed in a "lift-and-pull" type of movement. The bottoms of the upright support columns are secured to the building base, whether a foundation or floor slab, by means of base plates which permit inward and outward adjustment of the columns. This reduces the tolerances at which the anchors need be placed to properly locate the columns.

The frame is adapted to receive prefabricated sandwich-panels for both the roof and the walls. Alternatively, wood panels may be used for the roof, if desired.

Other features and advantages of the present invention will be apparent to persons skilled in the art from the following detailed description of a preferred embodiment accompanied by the attached drawing wherein identical reference numerals will refer to like parts in the various views.

THE DRAWING

FIG. 1A is a view similar to FIG. 1 showing additional stages of construction;

FIG. 8 is an exploded fragmentary view of a portion of the frame of the building of FIG. 1 showing various connections of the frame members;

FIG. 9 is an upper perspective view showing the attachment of sandwich-type roof panels to the rafters;

FIG. 10 is an upper perspective view in fragmentary form showing the attachment of wood panels to the rafters;

DETAILED DESCRIPTION

Figure 1:
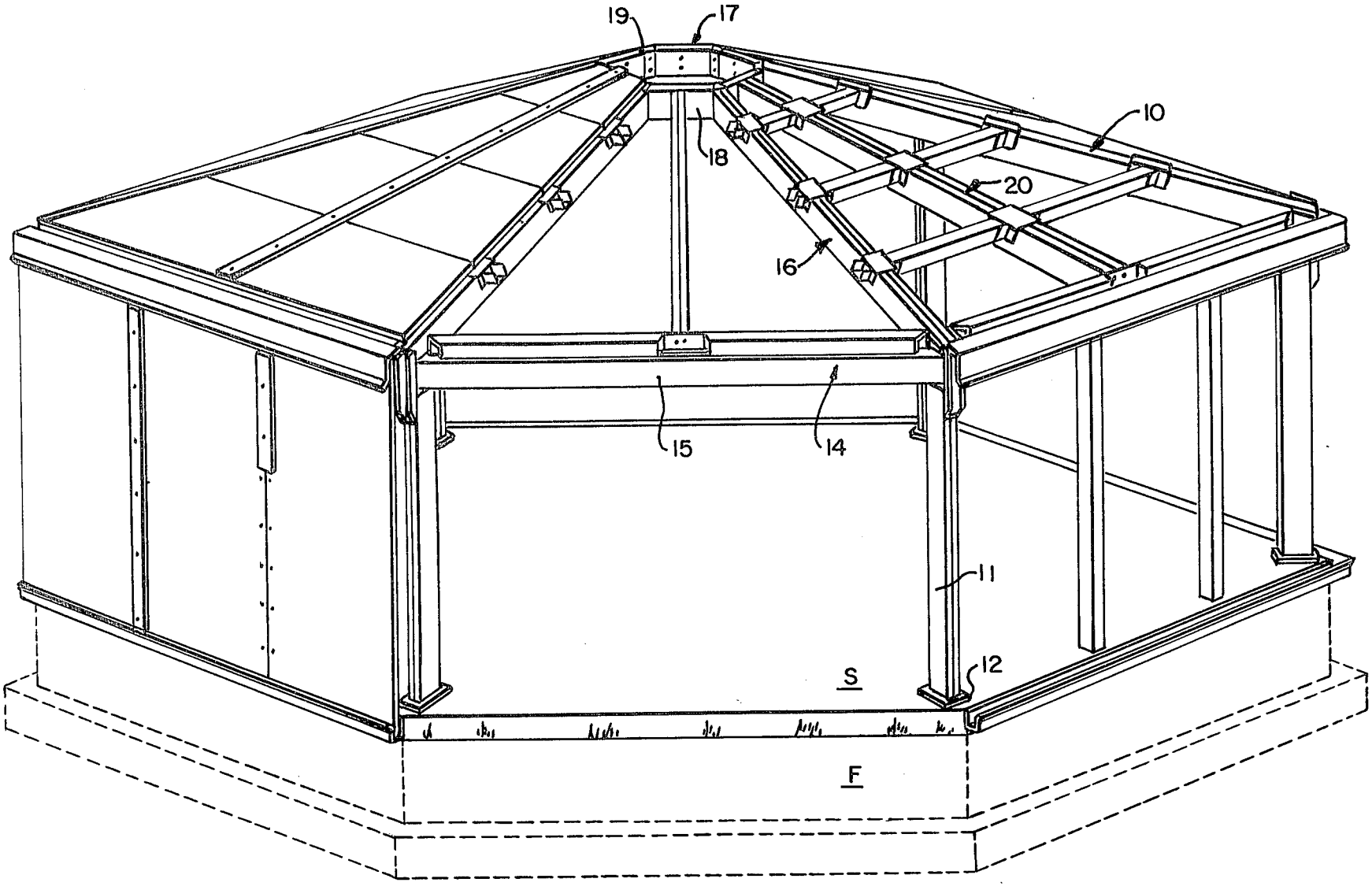
FIG. 1 is an upper perspective view of the structural frame, floor slab and foundation of a building incorporating the present invention without roof panels or wall panels.

Referring first to FIG. 1, reference numeral 10 generally designates a tubular steel frame for a structure having an hexagonal plan shape. The frame 10 is secured to a floor slab S which is laid on a conventional foundation F.

The frame 10 includes six upright columns 11.The support columns 11 are secured to the slab S by means of base plates 12, as will be discussed more fully below.

The tops of the support columns 11 are joined together with a tension ring generally designated by reference numeral 14 and comprising six individual tubular steel members or beams, each individually designated 15.

Extending upwardly from the tension ring 14, at the locations of the support posts 11 are six roof trusses 16. The inner, upper ends of the roof trusses 16 are joined together by a compression ring generally designated 17 and formed from weldmuts into a solid, rigid, integral element having six relatively long sides 18 joined by six relatively short sides 19. Roof rafters 20 extend between the centers of the tension ring members 15 and the centers of the longer sides 18 of the compression ring 17.

Figures 2, 3, 4, 5, 6, 7, 11:
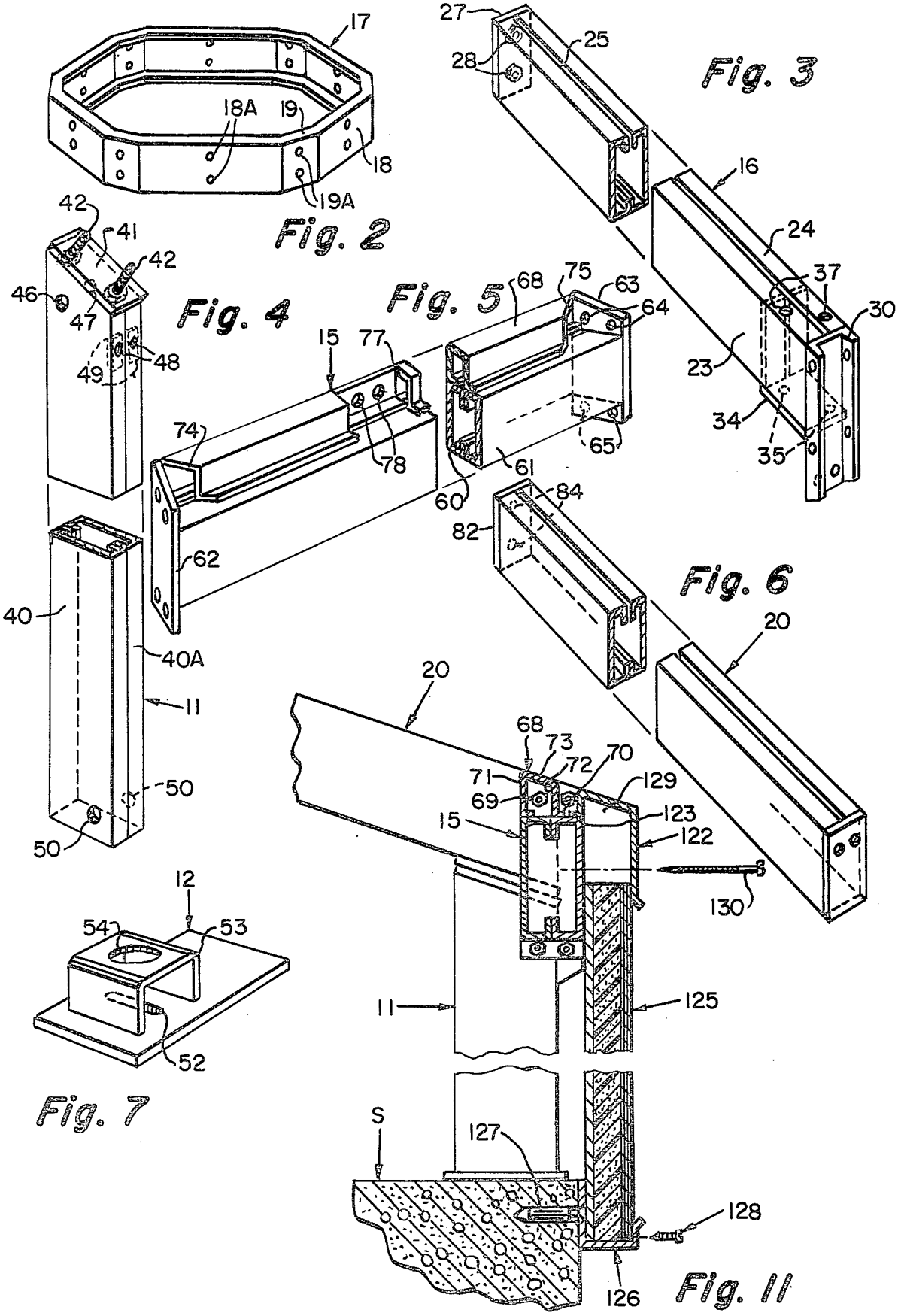
FIG. 2 is an upper perspective view of a compression ring for the building of FIG. 1.
FIG. 3 is an upper perspective view of a roof truss with the center portion cut away.
FIG. 4 is an upper side perspective view of a support column, again with the center cut away.
FIG. 5 is an upper perspective view of a tension ring member with the center cut away.
FIG. 6 is an upper perspective view of a rafter with the center cut away.
FIG. 7 is an upper perspective view of an adjustable base plate for securing the bottoms of the columns.
FIG. 11 is a vertical cross sectional view, in fragmentary form, illustrating a joint connection of column, truss and tension ring member, as well as the securement of wall panels.

Referring now to FIG. 2, the compression ring 17 is seen to be formed from steel channel members 18, 19 welded in the desired shape. The channel members 19 are flat to facilitate connection of the upper end of the roof trusses, and the longer sides 18 give a general hexagonal shape to the compression ring. A pair of apertures 18A are located one above the other in the center of each of the longer channel members 18, and a similar pair of apertures 19A are located at the center of each of the shorter channel members 19.

Referring now to FIG. 3, the trusses 16 are formed from two C-shaped channels 23, 24 which are held with their stiffeners facing one another and spaced slightly apart, and then welded at spaced locations, thereby leaving an elongated central slot 25 in the upper side thereof. The upper or inner end of each roof truss 16 is provided with an upper end plate 27, to the inner surface of which are welded a pair of threaded nuts 28 adjacent apertures in the end plate 27. These apertures register with the apertures 19A of the compression ring, and the truss 16 is secured to the compression ring by a pair of threaded bolts 29 passing through the apertures 19A and the end plate 27, and secured to the nuts 28.

Turning now to the outer or lower end of the roof truss 16, it is provided with a vertically extending U-shaped channel 30 which is welded to the end of the truss and extends downwardly therefrom. The flanges of the channel 30 are provided with a first pair of apertures 31 and a second pair of apertures 32. The lower surface of the roof truss 16 is also provided with a reinforcing plate 34 which defines a pair of apertures 35 which extend through the truss 16. The upper surface of the truss 16 is provided with a pair of larger apertures 37, in register with the apertures 35 to permit access to the apertures 35 to secure nuts to threaded studs which extend through the apertures 35, as will be discussed presently.

Turning now to FIG. 4, a support column 11 is seen in greater detail as including a pair of C-shaped channel members 40, 40A having their stiffeners welded together. The upper end of the support column 11 is cut at an angle and an end plate 41 is welded to it. A pair of threaded weld studs 42 are secured to the end plate 41 is register with the apertures 35 on the plate 34 of the truss 16.

As best seen in FIG. 8, after the support columns are installed, a roof truss is assembled to the top of the column by placing the plate 34 over the studs 42, and then by screwing nuts onto the studs 42 by inserting a tool to the enlarged apertures 37 in the truss 16.

Returning now to FIG. 4, the sides of the column 11 are apertured as at 46 and 47 respectively; and the front or outer side of the column contains a pair of upper apertures 48, behind which are welded threaded plates or nuts 49. Further, the sides of the column, at the bottom, contains a pair of enlarged apertures 50.

Turning now to FIG. 7, the base plate 12 is seen to include a flat plate which has an elongated slot 52 over which a bracket of inverted U shape 53 is secured by welding. An enlarged aperture 54 is provided in the top of the bracket 53. Turning now to the bottom of FIG. 8, an L-shaped anchor bolt 55 is embedded in the slab S and extends slightly above the top surface of the slab. The base plate 12 is placed on the top of the slab with the slot 52 extending over the top of the anchor bolt 55. A washer and threaded nut 56 are fastened onto the protruding end of the anchor bolt 55 to secure the base plate; and a bolt is passed through the apertures 50 and the bracket 53 to secure the bottom of the column 11 to the base of the building.

Referring now to FIGS. 5, 8 and 11, each tensioned ring member 15 includes a pair of C-shaped channel members 60, 61, welded together as described above and having its ends cut at a 60 degree angle. Enlarged end plates 62, 63 are welded to the ends of the tension ring beam formed from the channel 60, 61. The top edges of the plate 62, 63 are cut at an incline corresponding to the angle of the room, and each end plate includes a pair of upper apertures (designated 64 for the end plate 63 in FIG. 5), and a pair of lower apertures (designated 65).

A transition channel 68 is welded to the top of the tension ring beam, and as best seen in FIG. 11, it includes first and second welding flanges 69, 70, which are spaced and from which vertically extending portions 71, 72 extend respectively. The upper ends of the vertical extending portions 71, 72 are joined by a slanted portion 73 corresponding to the angle of the roof, and in alignment with the top surface of the rafter 20.

Returning to FIG. 5, the ends of the transition channel 68 are cut away as at 74, 75 to permit access to the upper apertures in the end plates 62, 63; and the center portion is cut away at 77 to permit access to a pair of apertures 78 to which the outboard end of the roof rafter is secured (see FIG. 8).

Referring now both to FIGS. 6 and 8, the rafters 20 are also formed from a pair of opposing C-shaped channel members 80, 81 which are welded together, and provided with end plates 82, 83. The upper end plate 82 includes a pair of vertically spaced apertures 84 corresponding to the spacing of the apertures 18A of the longer sides 18 of the compression ring 17; and the upper end of the rafters 20 are secured to the compression ring by a pair of bolts 85 fastened to nuts welded to the inside of the plate 82, similar to that shown in connection with the end plates 27. The lower end plate 83 is provided with a pair of laterally spaced apertures 88 which register with the apertures 78 of the transition channel 68 (see FIG. 8). The end plates 83 of the rafters 20 are thus attached to the transition channel 68 by a pair of bolts secured to internal weld nuts of the type already described.

In erecting the frame, the trusses are first connected to the tops of the columns 11 by means of the studs 42. These connected members are then secured to the base plates 12. The tension ring members 15 are connected to the already connected support columns 11 and trusses 16 by means of the end plates 62, 63. It will be observed that the upper left aperture 64 on the end plate 63 is in register with an aperture 90 on the truss 16. Similarly, the right upper aperture 64 is in register with the aperture 32 on the channel connector 30. The lower apertures 65 register respectively with the aperture 46 on the column 11 and the lower aperture 32 on the channel connector 30. Both are passed through the registered apertures and secured to weld nuts in the case of the apertures 90 and 46, and by means of loose nuts in the case of the apertures 32. It will thus be appreciated that the end plate of each tension ring member is directly secured both to an associated column and to a truss. Same column, truss and tension ring member are connected by means of the channel connector 30 which also serves to secure the next adjacent tension ring member to the joint. This is considered a very important feature of the invention because it provides a rigid joint when assembled, yet one which is easy to assemble and easy to disassemble, if desired.

Referring now to FIG. 9, there is shown a system for securing a sandwich-type roof panel 99 to the rafters and trusses, such as that designated 100 including a slot 101. A batten strip 102 extends along the joint between the adjacent panels, and the batten strip acts as a retainer, secured to the tubular frame element 100 by means of metal screws 103. The sandwich-type panels include an exterior facing 111 which may be a metal such as steel or aluminum, an inner core 112 of rigid foamed plastic, and an interior facing 113 which forms the ceiling of the building or structure. For constructions of this type, additional detail and improvements may be obtained from copending application of Morley Ben Byxbe, et al., Ser. No. 738,747, filed Nov. 4, 1976, for "Panel Roof Construction with Improved Joints".

Referring now to FIG. 10, an alternative roof structure using plywood or pressed board sheets 120 includes a plurality of spaced rafter hangers 122, each including a saddle 123 straddling a rafter 20 (or truss) and secured to it by means of a screw 124, together with laterally extending U-shaped hanger brackets 127 in which timber rafters 128 are laid. The roof panels 120 are then nailed to the timber rafters.

Referring now to FIG. 11, a base channel 126 is secured by means of concrete fasteners 127 to the slab S, for receiving wall panels 125. An upper panel retainer channel 122 is welded along a flange 123 to the top of the tension ring member 15. It will be observed that the height of the panel relative to the upper retainer channel 122 is such that there is a space 129 above the panel when fully assembled which is larger than the depth of the lower base channel 126. This permits each panel to be raised and dropped into place during assembly, or to be raised and removed from the base channel during disassembly.

Attaching screws 128 may be used to secure the base channel to the lower edge of the wall panels, and attaching screws 130 may be used to secure the panels 125 in place until it is desired to disassemble them. Batten strips and studs may be used to secure and feel adjacent edges of wall panels, as seen in FIG. 1A.

Figures 12, 13:
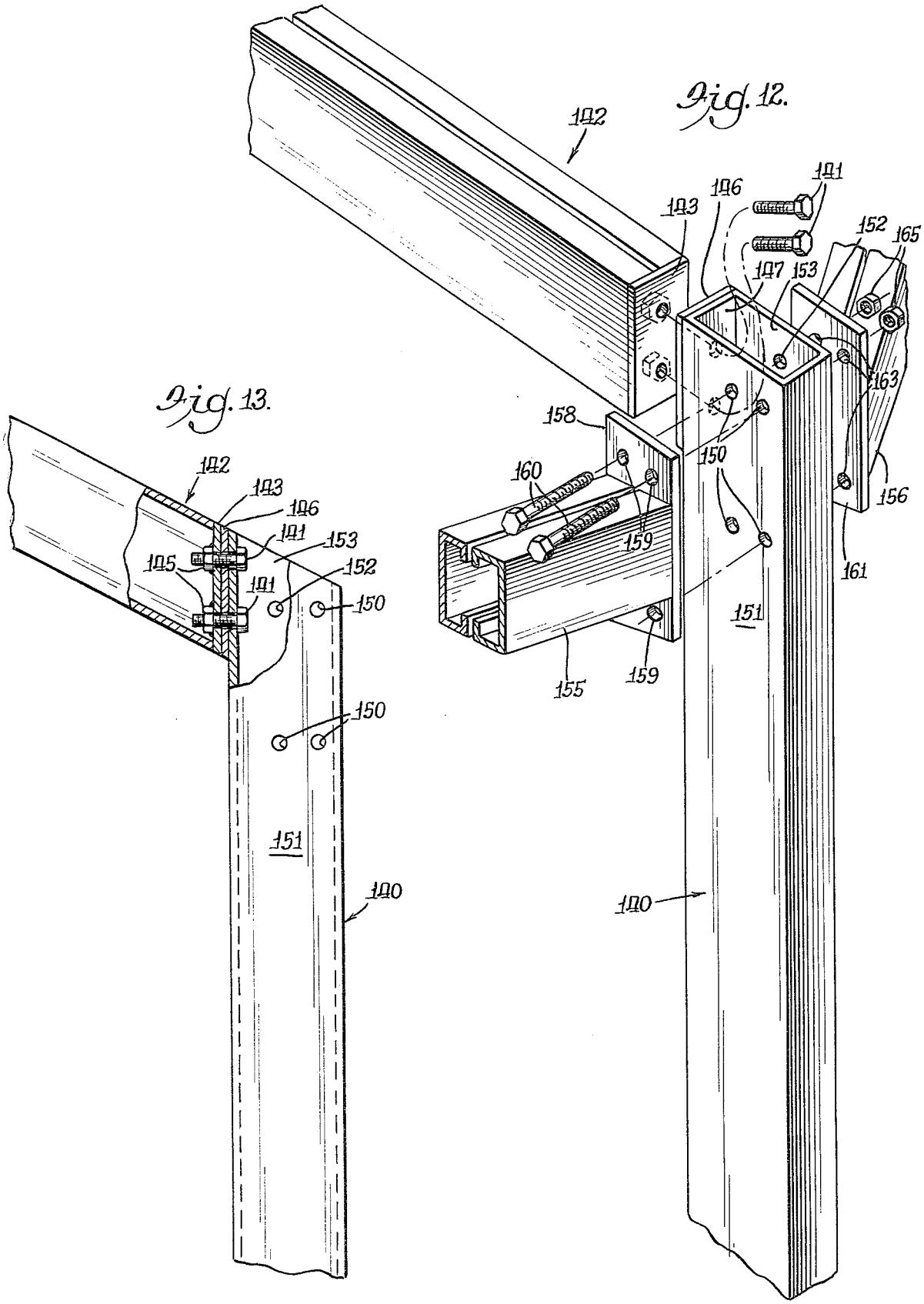
FIG. 12 is an exploded perspective view of a corner connection of an alternative embodiment.
FIG. 13 is a fragmentary side view of the truss/-column connection of FIG. 12, with portions broken away.

Referring now to FIGS. 12 and 13, there is shown a connection between column, roof trusses and tension ring members which is somewhat more economical than the embodiment of FIGS. 3-11, and has the further advantage that the end connector plate 30 of the previous roof truss is eliminated. The upright tubular column is generally designated 140, and it is open at the top to facilitate insertion of bolts 141 for connecting a roof truss 142. The roof truss 142 is provided with an end plate 143 which is welded to it. A pair of weld nuts 145 are welded to the interior of the end plate 143 for receiving the bolts 141. The abutting upper face of the column 140 has a strengthening plate 146 welded to it to engage the end plate 143 of the roof truss. The inner wall 147 of the column 140, the end plate 143 and the strengthening plate 146 all have apertures which are in register with the threaded aperture of the weld nut 145 for receiving the bolts 141, as illustrated in FIG. 13.

The opposing, longer side walls of the column 140 are provided with sets of four aligned apertures designated 150 (on wall 151) and 152 (on wall 153) respectively.

Adjacent tension ring members are designated 155 and 156 in FIG. 12, and they may be constructed as described in connection with the previous tension ring members. For simplicity, the transition channels described above and designated 68 are not shown. The tension ring member 155 is provided with an end plate 158 having four apertures 159 (only three of which are illustrated in FIG. 12) which are aligned with the apertures 150, 152 for receiving bolts 160. The end plate 158 may be welded to the end of the tension ring member 155, and a similar end plate is provided at the other end of that tension ring member, which corresponds to the end plate 161 welded to the adjacent tension ring member 156.

The tension ring end plate 161 is also provided with a set of four apertures 163 (only three being seen in FIG. 12) which align with the apertures 152 on the side wall 153 of the column 151.

Thus, the bolts 161 extend through aligned corresponding ones of the apertures 159, 150, 152 and 163 and are secured by nuts 165, thereby joining the tension ring members to the column. By providing proper strength through materials at these interfaces, the roof truss is connected directly to the column, as are the adjacent ends of the tension ring members, by means of end plates and bolts.

Having thus disclosed in detail preferred embodiments of the invention, persons skilled in the art will be able to modify certain of the structure which has been disclosed and to substitute equivalent elements for those illustrated while continuing to practice the principle of the invention; and it is, therefore, intended that all such modifications and substitutions be covered as they are embraced within the spirit and scope of the appended claims.

I claim:

1. A metal frame for a building structure of six or eight sides and adapted to have no interior roof-supporting columns comprising a plurality of upright tubular metal support columns; means for securing the bottom of each column to a base; a tubular metal truss extending upwardly from each column toward the center of said structure; a rigid, integral compression ring connecting the inner ends of all of said trusses; a tension ring connecting the outer ends of all of said trusses and including a plurality of individual tension ring members extending between adjacent columns; each of said tension ring members comprising a tubular beam formed from C-shaped channel members in facing relation welded together and including an end plate at each end, and a transition channel secured to the top thereof and defining a portion inclined at the same angle as the slope of the roof of said structure and cut away at the center portion thereof; a plurality of roof rafters extending between said tension ring members adjacent the cutaway portion thereof and said compression ring; first fastener means for connecting each column to the end plates of adjacent tension ring members, each truss comprising a tubular beam formed from C-shaped channel members in facing relation and welded together and including an end connecting member rigidly attached thereto; and second fastener means for connecting said end plate of each truss to an associated column.

2. The apparatus of claim 1 wherein the outer end of each of said rafters includes an end plate, said end plate and said transition channels each defining aligned apertures for receiving fastener means.

3. The apparatus of claim 2 further comprising a plurality of sandwich-type roof panels extending between adjacent ones of said trusses and rafters, said trusses and rafters defining upper elongated slots; batten strips overlapping adjacent edges of said roof panels; and fastener means for securing said batten strips to said slots by threading into said slots.

4. The apparatus of claim 1 wherein said means for securing the bottom of said column comprises a base plate resting on a slab and defining a laterally extending slot for receiving an anchor bolt embedded in said slab, and a bracket of inverted U-shape secured to the top of said plate above said slot and adapted to be received in the bottom of an associated tubular column; means for securing said plate to said anchor bolt; and bolt means extending through said column and through an associated bracket of said base plate.

5. The apparatus of claim 1 further comprising a base channel secured to said base and facing upwardly and adapted to receive a wall panel; an upper panel retainer channel secured to said tension ring and extending downwardly for securing the upper edge of said wall panel; and a wall panel held by said base channel and said upper retainer channel, the upper edge of said wall panel being spaced from the top of said upper retainer channel by a mount permitting said panels to be inserted by first inserting them in said upper retainer channel and then dropping them into said lower base channel.

6. The apparatus of claim 5 further comprising means for securing said wall panel to said base channel; and means for securing the top of said wall panel in said upper retainer channel.

7. A metal frame for a building structure of six or eight sides and adapted to have no interior roof-supporting columns comprising a plurality of upright tubular metal support columns; means for securing the bottom of each column to a base; a tubular metal truss extending upwardly from each column toward the center of said structure and including a connecting plate at the outboard end thereof, and including nuts welded to the inboard surface in register with bolt-receiving apertures; a rigid, integral compression ring connecting the inner ends of all of said trusses; a tension ring connecting the outer ends of all of said trusses and including a plurality of individual tension ring members extending between adjacent columns; said tension ring members comprising a tubular metal beam including an end plate at each end; first bolt fastener means extending through each column for securing the end plates of adjacent tension ring members against the respective sides of the associated column; and second bolt fastener means for securing said connecting plate of each truss in abutment with the upper portion of the inner wall of an associated column, access to said second bolt fastener means being gained through the open upper end of an associated tubular column.

8. The apparatus of claim 7 wherein each of said end plates of said tension ring members extend above and below said tension ring members and define apertures in register with the corresponding apertures of the end plate of the next adjacent tension ring member, the lateral walls of each associated column being interposed between and abutting opposing end plates of adjacent tension ring members and being apertured in register with the apertures on the adjacent tension ring end plates for receiving said first bolt fastener means.

* * * * *